United States Patent [19]

Bihy et al.

[11] Patent Number: 5,057,173

[45] Date of Patent: Oct. 15, 1991

[54] PROCESS FOR THE PRODUCTION OF NEEDLE FELT FROM ROCK WOOL

[75] Inventors: Lothar Bihy, Kaiserslautern; Hans Kummermehr, Ludwigshafen; Reinhard Stoyke, Dudenhofen, all of Fed. Rep. of Germany

[73] Assignee: Grunzweig + Hartmann AG, Ludwigshafen, Fed. Rep. of Germany

[21] Appl. No.: 416,228

[22] Filed: Sep. 26, 1989

[30] Foreign Application Priority Data

Oct. 13, 1988 [DE] Fed. Rep. of Germany ..... 3835007

[51] Int. Cl.[5] ..... B32B 17/00

[52] U.S. Cl. ..... 156/148; 156/62.2; 156/296; 28/112; 28/107; 428/289; 428/235

[58] Field of Search ..... 156/62.2, 62.6, 296, 156/148, 167; 428/289, 235; 28/112, 107; 264/109, 128; 65/4.4

[56] References Cited

U.S. PATENT DOCUMENTS

| | | | |
|---|---|---|---|
| 1,899,056 | 2/1933 | Powell | 65/4.4 X |
| 1,916,011 | 6/1933 | Mottweiler | 65/4.4 |
| 2,707,690 | 5/1955 | Pearson | 65/4.4 X |
| 3,331,669 | 7/1967 | Sinclair | 65/4.4 |

FOREIGN PATENT DOCUMENTS

| | | | |
|---|---|---|---|
| 1948553 | 4/1971 | Fed. Rep. of Germany | 28/112 |
| 2232785 | 10/1973 | Fed. Rep. of Germany . | |
| 3406932 | 12/1987 | Fed. Rep. of Germany . | |

*Primary Examiner*—Michael W. Ball
*Assistant Examiner*—Jeff H. Aftergut
*Attorney, Agent, or Firm*—Nixon & Vanderhye

[57] ABSTRACT

By combining two measures, namely by using rock wool fibers with a particularly low fiber thickness, and by adding an avivage agent with an unusually high viscosity, it is possible to needle a rock wool felt, without adding any other fibers, to produce a needle felt with high strength and good bendability. If the needle felt is subsequently relaxed with heat treatment, and the avivage agent is also expelled during this treatment, the needle felt is then available as a pure rock wool needle felt, free of any organic additives.

13 Claims, No Drawings

PROCESS FOR THE PRODUCTION OF NEEDLE FELT FROM ROCK WOOL

The invention concerns a process for the production of needle felt from rock wool.

It is known that rock wool, when subjected to a needling process, does not demonstrate any noticeable improvement in fiber interlocking. Therefore, it cannot be consolidated by means of a needling process, as a needle felt, so that in practice, the necessary consolidation takes place either with a self-curing binder, if the felt is needed as a more or less rigid sheet, or with mechanical means, for example in the form of so-called wire mats, where the rock wool felt is quilted with metal wire or something similar. While the use of a self-curing binder limits the possibilities of use of the rock wool sheet formed in this way, due to its stiffness and as the result of the introduction of a non-heat-resistant organic binder, wire mats are not suitable for use in corrosive environments and the possible raw density that can be achieved is limited.

Therefore there have been many attempts made to make rock wool suitable for a needling process, using a variety of treatments and additives. For example, it is known from DE-OS 22 32 785, that asbestos fibers can be added to the rock wool fibers, as a fleece-forming fiber additive, in order to thus obtain a felt that can be needled. Since the asbestos fibers exert extremely high friction on the needles of the needle bench, a lubricant is also added to the felt; this is expelled again under the effect of heat, after the needling process has been carried out. An aqueous solution or suspension of a volatile organic lubricant which does not contain metal, and does not leave any substances which could cause an alkali reaction after the lubricant is expelled, is suggested as a lubricant for this purpose. An aromatic or aliphatic polyglycol ether, fatty acid derivatives such as fatty acid ethanolamide, silicon oils or non-ionogenic tensides as well as anionic tensides free of alkali metals are suggested as suitable lubricants.

However, the addition of asbestos fibers is eliminated as a possibility right from the start, due to the harmful effects of asbestos fibers on health.

The invention is based on the task of providing a process for the production of needle felt from rock wool, which results in a needle felt composed exclusively of rock wool, without the addition of other fibers.

It was surprisingly shown that it is possible to accomplish the task, if rock wool with particularly thin fibers is used, and an agent with a viscosity that is unusually high for such textile additives is added to these fibers in the sense of an avivage. Rock wool fibers with a low average fiber thickness, of preferably less than 6 μm, can be obtained using the cross-blowing method or using nozzle-blowing methods, applying the teaching of the older German patent application P 38 07 420, and are therefore available. Avivages with a viscosity of preferably more than 2,000 cP are also commercially available, for example as dust binders based on mineral oil. Due to the use of particularly thin rock wool fibers, their brittleness and bending resistance are reduced, so that the fibers are more easily entrained by the needles of the needle bench and drawn into the rock wool felt, i.e. pulled through it, if the length of the fibers is sufficiently great. The avivage furthermore increases the suppleness of the thin fibers to a significant extent. The high viscosity of the avivage, which is added preferably in a weight proportion of the agent of at least 0.05%, relative to the weight of the dry rock wool, surprisingly allows a gliding movement of the fibers seized by the needles, in their anchoring position in the needle felt, if the upper limit of 10,000 cP is not exceeded, but holds the fibers in the position in which they have been placed by the needles during the needling process, after the needles have completed their work, due to the high viscosity. At the same time, interlocking between adjacent fibers is improved, and in this way, the effect of the needles is not limited to one thread each, or to only a few threads per needle; rather, a pulling effect is exerted by the threads directly seized by the needles, on adjacent threads, and in this way, the strength of the needle felt is further improved. Furthermore, this results in an expansion of the needle action to a larger area surrounding each needle, with the result that the entire web of rock wool is compacted to a significantly greater degree, for example several times as much, and that a thick textile cloth, similar to a wool blanket, with good strength and good handling properties, as well as excellent shaping properties, is produced, with a comparably higher raw density.

There are cases of applications in which the avivage is to remain in the needle felt, especially if their dust-binding effect is to be utilized for further handling of the needle felt. When using especially thin rock wool fibers and, if necessary, an increased amount of avivage additive, the needle felt produced in this way is sufficiently stable for further processing and at most demonstrates very slight resilience.

A felt web can be needled particularly well, according to the results of the experiments conducted, if it demonstrates a high puncture force pursuant to the test method according to Renault. In that method, an avivage is used for the felt web so that it withstands a puncture force of at least 100N, preferably 200–500N, using a free ring gap of 5 mm. Felt webs with such a puncture force demonstrate a structure which is advantageous for needling, according to our experience.

Testing according to Renault takes place on the basis of a method used by the Renault company. A sample, format 90 mm×90 mm, area weight 5.0 kg/m$^2$ for loose wool and 3.0 kg/m$^2$ for bound material, is clamped in a device between perforated plates and compressed to a thickness of 15 mm. Then the sample is punctured with a punch having a diameter of 30 mm and at a test velocity of 10 mm/min, where the axis of the punch aligns with the axis of the two openings in the plates. The lower opening has a circular shape and a diameter of 40 μm [sic], for example, so that a gap with a width of 5 mm results between the outer circumference of the punch and the edge of the lower supporting opening. The maximum puncture force is measured.

In a particularly preferred way, however, it is provided that the needled felt web is relaxed with a heat treatment at a temperature between about 300° C. and 500° C., very soon after having been needled. In this way, the bending stresses introduced into the fibers by the needling process and the accompanying deformations of the fibers are reduced, and any tendency of the rock wool fibers to spring back is eliminated. At the same time, the avivage is expelled, but its holding effect is no longer required, since there is no longer any tendency of the fibers to spring back.

The heat treatment preferably takes place under pressure stress on the needle felt, in order to prevent a shape change of the fibers as a result of the remaining resilience, before the stress has been reduced in the rock wool fibers, while the avivage is being expelled. As is easily evident, only a slight pressure, one that is sufficient to hold the fibers in the position they assumed in the needle felt after the needling process is required after the highly viscous avivage has been removed.

Since the avivage only has to prevent the rock wool fibers from springing back for a short period of time if heat treatment immediately follows the needling process, or if pressure stress starts immediately at the exit of the needling machine and is maintained until the heat treatment takes place, in this case, relatively thicker rock fibers at the upper limit of 6 μm and a minimum avivage content at the lower limit of 0.05% can be used for the process.

If needed, subsequent to heat treatment, treatment of the needle felt web with a conventional dust binder can take place, in order to minimize dust during further handling.

A preferred avivage agent is commercially available under the name PRAPAROL TM and another one is a formulation of alkyl phenol polyglycol ethers, containing mineral oil, which contains preferably about 15% polycylic aromatic compounds relative to the mineral oil content. Another avivage is commercially available under the name KOMPRESSOL TM which comprises a mixture of a mineral oil coming from a naphtha fraction with preferably about 20% predominantly nonionic emulsifier. These agents have a viscosity between 5,000 cP and 7,000 cP, while other dust binders, sizings or similar substances used in the textile industry possess a viscosity of only a few hundred cP. PRAPAROL TM or KOMPRESSOL TM are emulsified in water, and this emulsion, with a water proportion of about 90%, can be sprayed onto the fibers in the drop chute, below the fiber-producing unit, and can therefore be introduced in a uniform distribution. Excellent results have been obtained with the use of these avivage agents in an amount of 0.02 to 0.8 percent by weight, relative to the dry weight of the rock wool web.

We claim:

1. A process for producing needle felt from rock wool, comprising the steps of:

breaking stone melt into fibers having a diameter with a maximum frequency distribution of fiber diameter below 6 μm;

forming the fibers into a felt web;

providing the fibers with an avivage having a viscosity between 2,000 and 10,000 cP to improve their suppleness and in a minimum amount of 0.05 and a maximum amount of 5 per cent by weight thereof relative to a weight of dry felt web; and needling the felt with the fibers provided with the avivage to form a needled felt web.

2. A process according to claim 1 including relaxing the needled felt web with a heat treatment, at a temperature between about 300° C. and 500° C., subsequent to needling.

3. A process according to claim 2 including applying pressure to the needled felt web subsequent to needling.

4. A process according to claim 2 including adding a dust binder to the heat-treated felt web.

5. A process according to claim 1 wherein the felt web having avivage provided thereto is capable of withstanding a puncture force of at least 80N.

6. A process according to claim 5 wherein the avivage includes an agent based on mineral oil.

7. A process according to claim 6 wherein the agent is a formulation of alkyl phenol polyglycol ethers, containing mineral oil including polycylic aromatic compounds.

8. A process according to claim 6 wherein the avivage comprises a mixture of a mineral oil coming from a naphtha fraction with about 20% predominantly nonionic emulsifier.

9. A process according to claim 5 wherein the felt web with avigage provided thereto is capable of withstanding a puncture force of 150–200N.

10. A process according to claim 1 wherein the felt web having avivage provided thereto is capable of withstanding a puncture force of at least 100N.

11. A process according to claim 10 wherein the felt web with avivage provided thereto withstands a puncture force of 200–500N.

12. A process according to claim 1 wherein the fibers are provided with the avivage having a viscosity of between 3,000 and 7,000 cP.

13. A process according to claim 1 wherein the fibers are provided with the avivage in a minimum amount of 0.4–0.8 percent by weight thereof relative to the weight of the dry felt web.

* * * * *